United States Patent [19]

Lai

[11] Patent Number: 4,766,784

[45] Date of Patent: Aug. 30, 1988

[54] PNEUMATIC TOOL WITH A REPLACEABLE TOOL BIT TURNING SCREWS AND NUTS

[76] Inventor: Ban Lai, No. 2, Lane 58, Sec. 2, Ta-Ching St., Taichung, Taiwan

[21] Appl. No.: 143,584

[22] Filed: Jan. 13, 1988

[51] Int. Cl.[4] ..... B25B 13/46

[52] U.S. Cl. ..... 81/57.39; 81/465

[58] Field of Search ..... 81/57.39, 465, 57.19, 81/57.29, 57.31, 57.32, 180.1

[56] References Cited

U.S. PATENT DOCUMENTS 4,346,630 8/1982 Hanson ..... 81/57.39

*Primary Examiner*—Robert P. Olszewski
*Assistant Examiner*—Maurina Rachabe
*Attorney, Agent, or Firm*—McGlew and Tuttle

[57] ABSTRACT

A pneumatic tool for turning screws and nuts has a tool body including a driving member mounted rotatably thereon and capable of being pneumatically rotated. A ratchet wrench unit includes a crank and a swing arm. The crank has a crankshaft journaled in the ratchet wrench unit, and a crankpin. The swing arm is mounted rotatably in the ratchet wrench unit and is connected slidably to the crankpin so that the swing arm can be swung by the crankpin. The ratchet wrench unit is connected removably to the tool body in such a manner that the crankshaft can be rotated by the driving member. Instead of the ratchet wrench unit, a screwdriver may be mounted removably on the tool body in such a manner that the screwdriver can be rotated by the driving member.

5 Claims, 3 Drawing Sheets

PNEUMATIC TOOL WITH A REPLACEABLE TOOL BIT TURNING SCREWS AND NUTS

BACKGROUND OF THIS INVENTION

This invention relates to a pneumatic tool for turning screws or nuts, and more particularly to one which has a replaceable tool bit.

In this art, pneumatic wrenchs and pneumatic screwdrivers have been used for many decades. These pneumatic tools can efficiently loosen screws or nuts; however, a pneumatic wrench and a pneumatic screwdriver cannot be conveniently transported or carried together due to their bulkiness.

SUMMARY OF THIS INVENTION

It is therefore the main object of this invention to provide a pneumatic tool which has a replaceable tool bit for turning screws or nuts.

According to this invention, a pneumatic tool for turning screws and nuts has a tool body including a driving member mounted rotatably thereon and capable of being pneumatically rotated. A ratchet wrench unit includes a crank and a swing arm. The crank has a crankshaft journaled in the ratchet wrench unit, and a crankpin. The swing arm is mounted rotatably in the ratchet wrench unit and is connected slidably to the crankpin so that the swing arm can be swung by the crankpin. A first coupling means is provided for connecting removably the ratchet wrench unit to the tool body in such a manner that the crankshaft can be rotated by the driving member. Instead of the ratchet wrench unit, a screwdriver may be connected removably to the tool body by a second coupling means in such a manner that the screwdriver can be rotated by the driving member.

BRIEF DESCRIPTION OF THE DRAWINGS

Other features and advantages of this invention will become apparent in the following detailed description of a preferred embodiment of this invention with reference to the accompanying drawings in which.

DETAILED DESCRIPTION OF THE PREFERRED EMBODIMENT

Figure 1:
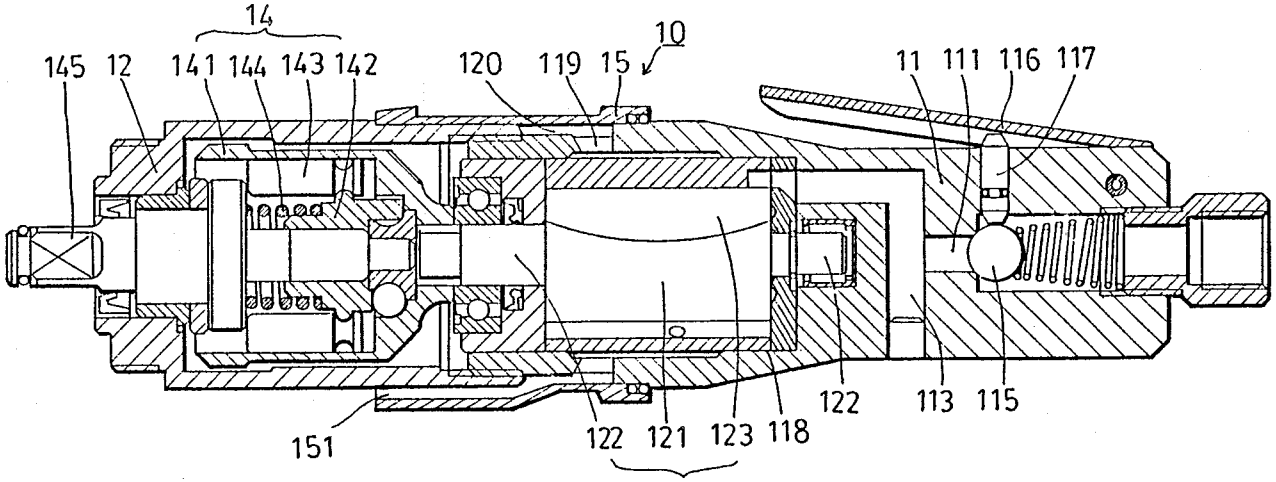
FIG. 1 is a sectional view showing the tool body of a pneumatic impact tool for turning screws and nuts by imparting rotary impacts in accordance with this invention.
Figure 3:
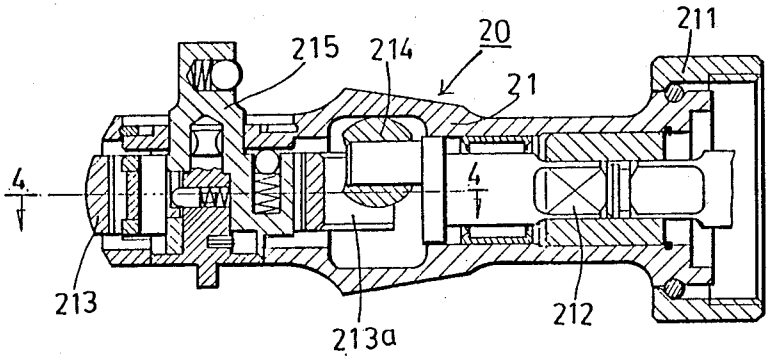
FIG. 3 is a sectional view showing a ratchet wrench unit of the pneumatic impact tool in accordance with this invention.
Figure 5:
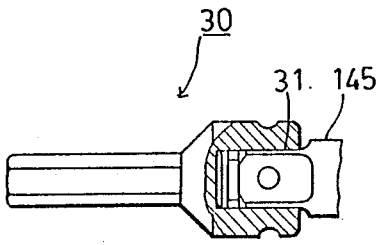
FIG. 5 is a sectional view showing a screwdriver of the pneumatic impact tool in accordance with this invention.

Referring to the accompanying drawings, a pneumatic impact tool includes a tool body 10 shown in FIG. 1, a ratchet wrench unit 20 shown in FIG. 3, and a screwdriver 30 shown in FIG. 5. Either the ratchet wrench unit 20 or the screwdriver 30 may be coupled with the tool body 10, as described hereinafter.

Figure 2:
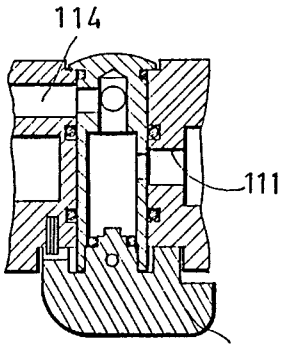
FIG. 2 is a sectional view showing an air passage in the tool body in accordance with this invention.

The tool body 10 has a handle 11 in which an intake passage 111 is formed. A control of switch 112 (see FIG. 2) permits air from the intake passage 111 to flow into either a first branch passage 113 (see FIG. 1) or a second branch passage 114 (see FIG. 2). A chamber 118 is communicated with the first branch passage 113 and the second branch passage 114. A rotor 121 is disposed within the chamber 118 and has a rotating shaft 122 journaled in the tool body 10, and a plurality of rotating blades 123. When air flows from the first branch passage 113 into the chamber 118, the rotor 121 rotates clockwise. Conversely, when air flows from the second branch passage 114 into the chamber 118, the rotor 121 rotates counterclockwise.

A spring biased ball 115 normally closes the intake passage 111. When it is desired to open the intake passage 111 in order for access of air to the intake passage 111, a trigger 116 may be pressed so that a pin 117 is impelled to move the ball 115 away from the inlet of the intake passage 111, thereby permitting compressed air to enter the intake passage 111.

The rotation of the rotating shaft 122 of the rotor 121 may be transferred to a driving shaft 145 by a conventional rotary impact clutch 40. As illustrated, the driving shaft 145 is provided with a square plug at its end. The clutch 40 includes a hammer 141, a cam 142, a pair of dog pins 143, and a helical coil biasing spring 144. Because the clutch 14 has been disclosed in U.S. Pat. No. 4,313,505 to Silvern, more detailed description thereof is omitted. The clutch 14 can impart rotary impacts to the driving shaft 145 so as to easily loosen screws or nuts.

The chamber 118 has an outlet 119 with which an annular exhaust passage 120 is communicated. The annular exhaust passage 120 is disposed between the handle 11 and a tool body outer housing 12. A rotary ring 15 is sleeved rotatably on the handle 11 and the tool body outer housing 12. The annual exhaust passage 120 is formed inside the rotary ring 15 so that an orifice 151 in the rotary ring 15 is communicated with the exhaust passage 120. Thus, the rotary ring 15 may be rotated to remove compressed exhaust from the tool body 10 through the orifice 151 in a selected direction so as to prevent the compressed exhaust from ejecting toward the user. If the compressed exhaust were to eject toward the user, the user could be injured.

Figure 4:
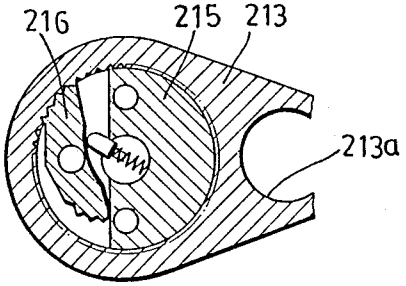
FIG. 4 is a sectional view taken along the line 4—4 in FIG. 3.

The ratchet wrench unit 20 includes an outer housing 21. A nut 211 is sleeved rotatably on the tail end of the outer housing 21 and engages threadably with the tool body outer housing 21. A crankshaft 212 is journaled in the outer housing 21. A square socket is provided on the tail end of the crankshaft 212 and engages snugly with the plug of the driving shaft 145. A generally oval hollow guide 214 is sleeved rotatably on the end portion of the crankpin 214. The ratchet wrench unit 20 has a conventional ratchet wrench body (see FIG. 4) which includes a swing arm 213 sleeved rotatably on a driven socket member 215 and a pawl 216. The swing arm 214 has a free end surface in which a restricted slide groove **213*a* is formed. The guide 214 is limited to sliding only in the slide groove 213*a*. When the crankshaft 212 rotates, the rotating guide 214 slides to and fro along the slide groove 213*a* to intermittently rotate the driven socket member 215**.

The ratchet wrench unit 20 may be replaced with the screwdriver 30. The screwdriver 30 also includes a square socket 31 so that it may engage with the driving shaft 145.

With this invention thus explained, it is apparent that numerous modifications and variations can be made without departing from the scope and spirit of this invention. It is therefore intended that this invention be limited only as indicated in the appended claims.

I claim:

1. A pneumatic tool for turning screws and nuts comprising:

a tool body including a driving member mounted rotatably thereon and capable of being pneumatically rotated;

a ratchet wrench unit including a crank having a crankpin and a crankshaft journaled in said ratchet wrench unit, and a swing arm mounted rotatably in said ratchet wrench unit and connected slidably to said crankpin so that said swing arm can be swung by said crankpin;

a first coupling means for connecting removably said ratchet wrench unit to said tool body in such a manner that said crankshaft can be rotated by said driving member;

a screwdriver; and a second coupling means for connecting removably said screwdriver to said tool body in such a manner that said screwdriver can be rotated by said driving member;

whereby, either said ratchet wrench unit or said screwdriver may be coupled removably with said tool body.

2. A pneumatic tool as claimed in claim 1, wherein said swing arm has a free end surface in which a restricted slide groove is formed, and wherein said crankpin includes a hollow guide sleeved rotatably on an end thereof and is limited by said groove to sliding only in said slide groove when said crankpin is rotated.

3. A pneumatic tool as claimed in claim 1, wherein said first coupling means includes a tool body outer housing, a ratchet wrench unit outer housing engaged threadably with said tool body outer housing, a socket secured to an end of said crankshaft, and a plug secured to an end of said driving member for being well-matched with said socket, said ratchet wrench unit and said tool body being shaped so that they may rotate synchronously when they are engaged with each other.

4. A pneumatic tool as claimed in claim 1, wherein said second coupling means includes a socket secured to an end of said screwdriver, and a plug secured to an end of said driving member for being well-matched with said socket, said screwdriver and said tool body being shaped so that they may rotate synchronously when they are engaged with each other.

5. A pneumatic tool as claimed in claim 1, wherein said tool body includes an annular exhaust passage formed in a cylindrical side surface, and a rotary ring sleeved rotatably on said tool body around said exhaust passage and having an orifice communicated with said exhaust passage, whereby, said rotary ring can be rotated so that exhaust flows out of said tool body in a predetermined direction.

* * * * *